US005233137A

United States Patent [19]

Geddes

[11] Patent Number: 5,233,137

[45] Date of Patent: Aug. 3, 1993

[54] PROTECTIVE ANC LOUDSPEAKER MEMBRANE

[75] Inventor: Earl R. Geddes, Livonia, Mich.

[73] Assignee: Ford Motor Company, Dearborn, Mich.

[21] Appl. No.: 895,502

[22] Filed: Jun. 8, 1992

Related U.S. Application Data

[63] Continuation-in-part of Ser. No. 514,624, Apr. 25, 1990, Pat. No. 5,119,902.

[51] Int. Cl.[5] ..... F01N 1/06

[52] U.S. Cl. ..... 181/206; 381/71

[58] Field of Search ..... 181/206, 207; 381/71

[56] References Cited

U.S. PATENT DOCUMENTS

| | | | |
|---|---|---|---|
| 1,969,704 | 8/1934 | D'Alton | 181/156 |
| 4,153,815 | 5/1979 | Chaplin et al. | 381/71 |
| 4,473,906 | 9/1984 | Warnaka et al. | 181/206 |
| 4,480,333 | 10/1984 | Ross | 381/71 |
| 4,549,631 | 10/1985 | Bose | 181/156 |
| 4,669,122 | 5/1987 | Swinbanks | 381/71 |
| 4,677,676 | 6/1987 | Eriksson | 381/71 |
| 4,677,677 | 6/1987 | Eriksson | 381/71 |
| 4,736,431 | 4/1988 | Allie et al. | 381/71 |
| 4,783,817 | 11/1988 | Hamada et al. | 381/71 |
| 4,805,733 | 2/1989 | Kato et al. | 181/206 |
| 4,815,139 | 3/1989 | Eriksson et al. | 381/71 |
| 4,837,834 | 6/1989 | Allie | 381/71 |
| 4,876,722 | 10/1989 | Dekker et al. | 381/71 |
| 4,878,188 | 10/1989 | Ziegler, Jr. | 364/724 |
| 5,119,902 | 6/1992 | Geddes | 181/206 |

FOREIGN PATENT DOCUMENTS

| | | |
|---|---|---|
| 768373 | 8/1934 | France . |
| 2191063 | 12/1987 | United Kingdom . |

OTHER PUBLICATIONS

AES Bandpass Loudspeaker Enclosures, Publication Nov., 1986, 2383.

*Primary Examiner*—Michael L. Gellner
*Assistant Examiner*—K. Dang
*Attorney, Agent, or Firm*—Roger L. May; Mark L. Mollon

[57] ABSTRACT

A transducer arrangement for active noise cancellation signals provides an acoustically permeable membrane between ports in direct communication with the noise propagating conduit and the transducers delivering sound pulses to the port. A housing defines at least one chamber exposed to at least one face of a transducer diaphragm, and each chamber is connected in fluid communication with the conduit through at least one port. The chamber is partitioned by the membrane to include chamber portions with a predetermined volumetric relationship. In a preferred embodiment where the transducer arrangement is coupled to a motor vehicle exhaust conduit, the membrane is preferably a silicone impregnated polyurethane film reinforced with aromatic polyamide fibers. Such a member provides a waterproof, acoustically permeable partition between the port and any adjacent speaker face that can withstand high temperatures. In a two transducer arrangement, two diaphragm faces are exposed to a common chamber including two membranes positioned on opposite sides of the port communicating with the chamber.

19 Claims, 3 Drawing Sheets

PROTECTIVE ANC LOUDSPEAKER MEMBRANE

CROSS REFERENCE TO RELATED APPLICATIONS

The present application is a continuation-in-part of application Ser. No. 514,624, filed Apr. 25, 1990, now U.S. Pat. No. 5,119,902, entitled "Active Muffler Transducer Arrangement".

TECHNICAL FIELD

The present invention relates generally to active noise cancellation apparatus, and more particularly to transducer arrangements protecting transducers such as loudspeakers from harsh environments such as in motor vehicles for motor vehicle noise cancellation.

BACKGROUND ART

There have been many recent developments in active noise cancellation to improve the generation of cancellation signals emitted into a conduit at a location where the propagating noise wave is 180° out of phase with the introduced sound cancellation signal. While some previously known improvements to the signal control circuitry and are discussed in previously known patent references, these sound cancellation systems do not address protection of the transducer from a destructive environment such as motor vehicle exhaust conduits. Rather previously known improvements to the control 60, for example, enabling it to react to changing characteristics of the sound pressure pulses due to changes at the source, or other improvements such as improved positioning or alignment of components to avoid feedback of the signal generated from the loudspeaker which is received at the transducer 12, or error compensation devices which readjust the control 60 in response to the actual degree of cancellation resulting from operation of a transducer, show that previous developments exhibit a substantially different emphasis for development of noise cancellation systems.

My previous patent applications cover transducer arrangements in which transducers are mounted in housings outside of the exhaust conduit but communicating with the conduit through elongated ports. Although the limited fluid communication through the port and the physical separation of the housing from the conduit provides some reduction in temperatures to which the transducer is subjected, the transducer remains exposed to gases or fluids passing through the conduit. In particular embodiments, such as motor vehicle exhaust systems, such exposure substantially reduces the life of the transducer.

For example, the sleeve carrying the transducer coil is joined to the transducer diaphragm by bonding, glue or other securing means which can be adversely affected by high temperature, humidity or contamination. Moreover, the joint is subjected to forces, stress reversals, aging and cycling during operation of the transducer. Accordingly, the joint may be recognized as a key part of the transducer to protect from environmental conditions affecting the integrity of the joint.

TECHNICAL PROBLEM RESOLVED

The present invention overcomes the abovementioned disadvantages by providing an acoustically permeable partition between a transducer and a port communicating with the sound propagating conduit. Moreover, in transducer assemblies structured so that each side of the transducer diaphragm is exposed to a chamber ported to the sound propagating conduit, at least one membrane according to the present invention separates at least one diaphragm side from the ports in open fluid communication with the noise propagating conduit. In addition, each membrane may separate one or more diaphragm sides from direct fluid communication with the conduit. Accordingly, the present invention provides a particularly advantageous construction for protecting transducers from harsh environmental conditions, for example, those encountered in a motor vehicle exhaust system.

In general, the membrane must be able to pass sonic output having frequency components within the range of the noise propagating source. In addition, a membrane used, for example, in motor vehicle exhaust must be waterproof to insulate the transducers from humid conditions as results from combustion by-products.

Furthermore, the membrane must be able to withstand the temperatures to which it is to be subjected. Accordingly, the membrane of the preferred embodiment has a predetermined mass density with a preferred range around 1 kg/m$^2$ surface density$\pm$200% and low mechanical resistance in order to perform its intended function.

In the preferred embodiment, the membrane is shaped to correspond with the shape of the housing in which it is mounted. Preferably, a cylindrical housing corresponds with the circular periphery of a transducer, and the membrane would likewise have a circular shape. The membrane comprises a waterproof layer of Kevlar impregnated silicone with polymer fibers such as aromatic polyamide such as that available under the DuPont trademark KEVLAR®. In a motor vehicle exhaust system, the membrane is exposed to extremely high temperatures, and the silicone withstands direct exposure to the high temperature environment. Moreover, the preferred membrane has a compliance which provides a resonant frequency at or near the high end of the bandwidth of the noise signal propagating through the conduit.

Furthermore, while known prior art examples of sound cancellation transducers employ a single face of the transducer diaphragm to produce cancellation pulses, the present invention may be employed where preferably both the front face and the rear face of a loudspeaker diaphragm may be used. In such a system, each movement of the diaphragm generates a pulse in the front side which is 180° out of phase with the pulse generated at the rear side, and the pulses are controlled by tuning or spacing of chambers exposed to the diaphragm sides and the ports that deliver the sonic pressure pulses through the chambers to the noise propogating circuit.

As a result, the present invention provides a sound cancellation system with a desired acoustical response without subjecting the components to extremely harsh environments. High performance transducers and high performance transducer housings for maximizing the output of the sonic waves generated by a transducer diaphragm can communicate acoustically with the noise propagating conduit through appropriate tuned port assemblies. However, the membrane restricts moisture, contamination and heat exposure to the diaphragm and other components used to operate, construct or mount the transducer. As a result, the present invention is particularly well adapted for use in an active noise cancellation muffler for motor vehicles.

BRIEF DESCRIPTION OF THE DRAWING

The present invention will be more clearly understood by reference to the following detailed description when read in conjunction with the accompanying drawing in which like reference characters refer to like parts throughout the views and in which.

BEST MODE FOR CARRYING OUT THE INVENTION

Figure 1:
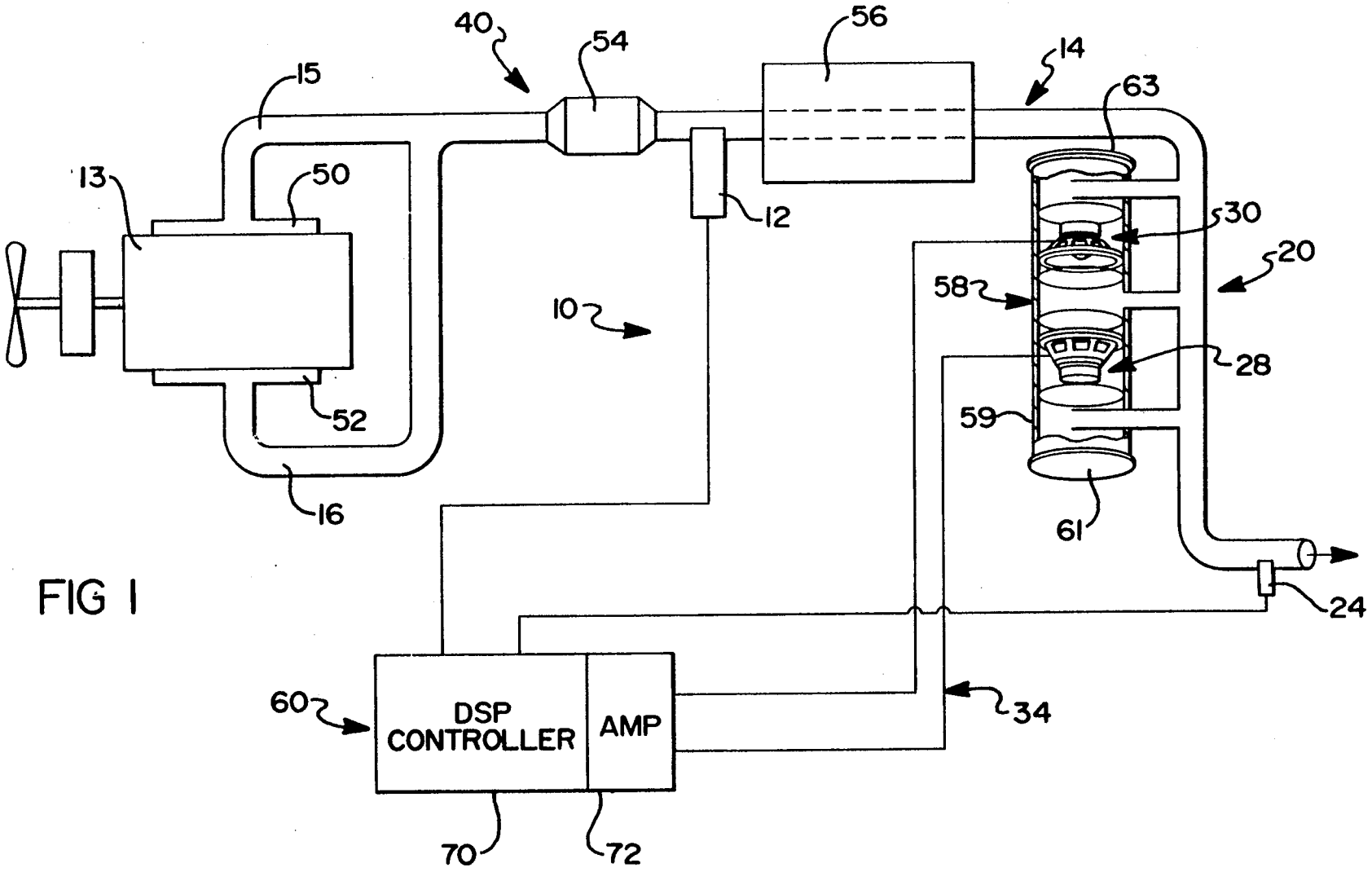
FIG. 1 is a diagrammatic view of a motor vehicle exhaust system including an active noise cancellation transducer construction according to the present invention.

Referring first to FIG. 1, a motor vehicle exhaust system 40 is thereshown coupled to an engine 13. While the present invention is particularly well adapted for use as a motor vehicle muffler as is described in the preferred embodiment, it will be understood that the invention is applicable with numerous other sound cancellation systems and is not so limited. Nevertheless, the following detailed description discussing advantages appreciated in the system of the preferred embodiment will serve to address features and advantages in noise cancellation systems unrelated to exhaust systems.

Referring first to FIG. 1, an active noise cancellation system 10 is diagrammatically illustrated as part of a motor vehicle exhaust system 40. The cancellation system 10 includes a microphone or transducer 12 exposed to a sound pressure pulse train delivered from the motor vehicle engine 13 to a common exhaust conduit 14. The electrical signal generated by the transducer 12 in response to the detected sound pressure pulses in the conduit 14 is fed into electronic control 60 which in turn drives a transducer such as a loudspeaker. As is well known, the control 60 drives the transducer so that the sound pressure generated by the speaker can be introduced to the conduit 14. The emission occurs at a point at which pulses emitted from the loudspeaker have the same magnitude and are 180° out of phase with the sound pressure pulses passing through the conduit 14 at that point. The transducer assembly 20 used in the preferred embodiment is described in greater detail below.

The exhaust system 40 for the motor vehicle engine 13 includes the common exhaust conduit 14 coupled to exhaust pipes 15 and 16 communicating with the exhaust manifolds 50 and 52 respectively. The common exhaust conduit 14 refers generally to the path communicating with the exhaust pipes 15 and 16 regardless of the individual components forming the passageway through which the exhaust gases pass. For example, the catalytic converter 54 and the passive muffler accessory 56 form part of the conduit 14, while the transducer assembly 20 includes an active noise cancellation transducer housing 58 connected by ports for fluid communication with the conduit 14. The housing 58 could also be constructed to support or to form part of the conduit 14.

The catalytic converter 54 and the passive muffler accessory 56 may be of conventional construction for such items and need not be limited to a particular conventional construction. For example, simple noise damping insulation can be carried in a closed container, for example, to reduce vibrations in susceptible portions of the conduit 14, or to combine the passive muffler accessory 56 with an active noise cancellation system such as to more effectively reduce the high frequency components of the noise signal.

In addition, the exhaust system 40 with active noise cancellation system 10 employs a sensor 12 and a feedback sensor 24 as well as the transducer arrangement 20 carried by the transducer housing 58. The electronic control 60 includes a digital signal processing (DSP) controller 70 generating a signal responsive to the signal representative of detected noise in order to generate the transducer drive signal. The drive signal is delivered to the transducer arrangement 20 for emitting the cancellation signal. In addition, the controller 70 includes an amplifier circuit 72 that provides sufficient amplitude to the drive signal for the transducers in the transducer arrangement 20 to emit sonic pulses that match the amplitude of pressure pulses passing the locations at which the transducer arrangement 20 communicates with the conduit 14.

Figure 2:
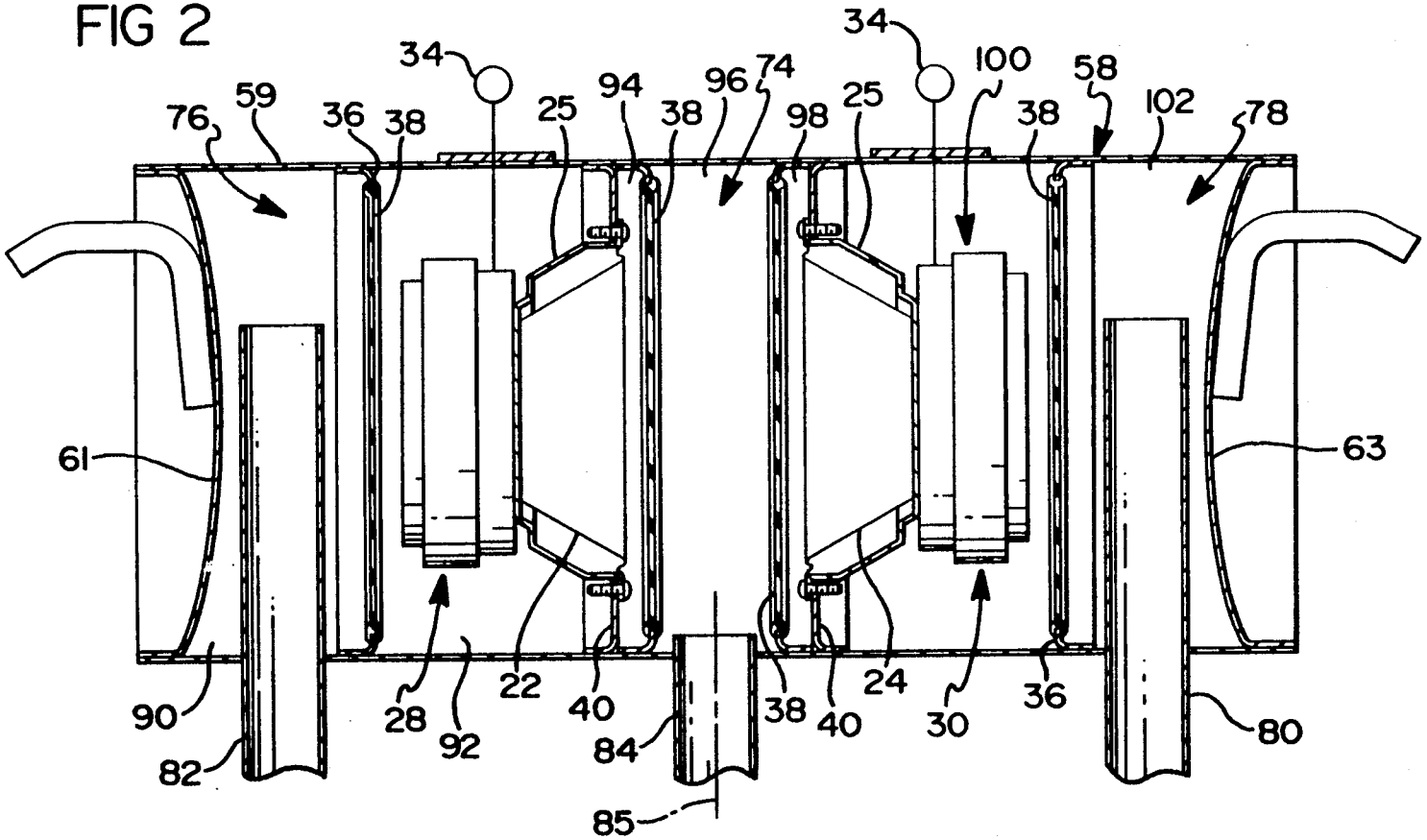
FIG. 2 is an enlarged sectional view of a transducer construction shown in FIG. 1 and constructed with multiple membranes according to the present invention.

As best shown in FIG. 2, the housing 58 includes a cylindrical wall 59 enclosed by end walls 61 and 63. The peripherally cylindrical wall 59 engages the support frames for two transducers 28 and 30 each transducer having a frame 25. The support frames are formed by ring brackets 40 welded to the wall 59 and bolted to the portion of transducer frames 25 surrounding the diaphragms 22 and 24. The brackets 40 define an interface forming a mounting seal 44 between the front and rear sides of each transducer diaphragm that acoustically separates the front and rear sides of each diaphragm. The front sides of each transducer diaphragm communicate with a common chamber 74, defined by the transducers 28 and 30, primarily their diaphragms 22 and 24, respectively, as well as by the peripheral wall 59.

Each transducer 28 and 30 is structured in a conventional manner, having a magnet 20 extending beyond the rear face of its respective diaphragm and mounted to the transducer frame 25, and need not be described in further detail for the purpose of describing the present invention. However, the diaphragm may preferably be made of stainless steel while the surround or mounting seal 44 is a Kevlar impregnated silicone, similar to the membrane described in detail below. However, such material is bonded to the surround by in-mold polymerizing of the material on the diaphragm cone. Similarly, electrical connections to the transducers 28 and 30 are conventional and referred to only diagrammatically at 34.

The rear side of transducer diaphragm 22 communicates with a chamber 76 defined between end wall 61 and the diaphragm 22 including mounting seal 44 formed by the silicone surround bonded to the transducer frame 25 around diaphragm 22 of transducer 28. Similarly, the rear side of the transducer diaphragm 24 communicates with the chamber 78 defined between end wall 63 and the diaphragm 22 including mounting seal 44 formed by the silicone surround bonded to the transducer frame 25 around diaphragm 24 of transducer 30.

As also shown in FIG. 2, the chamber 76 communicates through a port 82 with the exhaust conduit 14. The chamber 78 communicates through a port 80 with conduit 14 at a spaced apart position from the port 82. A port 84 couples chamber 74 in communication with the exhaust conduit 14 at a position intermediate ports 80 and 82. Each of the ports 80, 82 and 84 is in direct communication with the hot exhaust gases in the conduit 14.

In accordance with the present invention, each of the chambers 74, 76 and 78 is partitioned to seal off fluid communication between each of the ports and the adjacent transducer structure. However, the partition is constructed with an acoustically permeable membrane 38 permitting sound pressure pulses emanating from the adjacent face of the transducer diaphragm to reach the adjacent port. A peripheral ring 36 carries the membrane, preferably so that it remains taut. The ring 36 is secured to the wall 59, preferably by welding or the like.

In the preferred embodiment, the membrane is formed from a Kevlar impregnated silicone material reinforced with an aromatic polyamide fiber substrate. An example of such a membrane is available as Drumheads by I.E.R. Division of Furon, Inc. Such a membrane provides a waterproof barrier between the port and the transducer and withstands exposure to the high temperatures typically encountered in the exhaust gas environment of the exhaust conduit 14. Moreover, the strengthening fibers resist distortion of the membrane which can interfere with the acoustic permeability of the membrane. The membrane is flexible but supported so that it remains taut to reduce interference with sonic pulses passing across the membrane. Another example of membrane for use in substantially lower temperature applications may be mylar.

It is preferable to tune the chambers and ports for a particular resonant frequency within the bandwidth of the noise signal to be canceled. As discussed in my copending application Ser. No. 514,624, filed Apr. 25, 1990, entitled "Active Muffler Transducer Arrangement," the resonant frequency is proportional to $(L \cdot V)^{-\frac{1}{2}}$ for a given port area, where L is the length of the port and V is the volume of the chamber. Proper dimensioning of the port and the chamber with which it communicates enables the signals emanating from the front sides of the transducers 28 and 30 to add to each other and minimizes the need for more powerful electronics otherwise required in the amplifier 72. Preferably, the length of the port 74 is selected to tune the chamber and port at a resonant frequency at or near the highest frequency of the cancellation signal bandwidth. In a similar manner, the length of ports 80 and 82 is selected for tuning at a frequency at or near the lowest cutoff frequency in the cancellation signal bandwidth. Such dimensioning improves efficiency and reduces power requirements, particularly where it is needed at the lowermost portion of the cancellation signal spectrum.

In addition, to maintain the tuning of the chambers and ports, the positions of the acoustically permeable membranes may be selected to reduce adverse affects upon the tuning. In a model of transducer arrangement 20 where the cylindrical wall 59 has a diameter of 0.21 m, membranes having a substantially coextensive diameter of 0.208 m were positioned to provide particular volumetric relationships between the partitioned portions of each chamber. The slightly smaller diameter of the membrane is due to the 1 millimeter radial dimension of the support ring 36 for each membrane 38. The outer, rear section of chambers 76 in direct contact with the port 82 is provided with a volume of 0.0028 $m^3$, with the membrane positioned 0.08 m from the end wall 61. The inner rear section 92 between the membrane 38 and the rear of the transducer 28 is provided with a volume of 0.0027 $m^3$, where the membrane is positioned 0.104 m from the support frame 40 carrying transducer 28, and reducing the volume of the chamber by accounting for the volume of 0.0009 $m^3$ occupied by the speaker structure within the chamber. The inner, front chamber portion 94 has a volume of 0.0007 $m^3$ where the membrane is spaced 0.015 m from the frame 40 and including the volume of 0.0002 $m^3$ provided in the speaker cone 22. The outer front chamber portion 96 is defined between the support rings 36 for the two membranes 38 mounted in front of the frames 40, and has a volume of 0.0018 $m^3$ representing a separation of 0.051 m and positioned on opposite sides of the port 84 equidistant from the center line 85 of the port 84. The volumes of chamber portions 98, 100 and 102, and the corresponding membrane positions, are determined as previously discussed for chamber portions 94, 92 and 90, respectively, and need not be repeated.

Each of the rear area ports 82 and 80 have an area of 0.0008 $m^2$ with a radius of 0.016 m. Accordingly, the tuning length is calculated as 0.17 m for the rear chambers 76 and 78. As a result, it will be understood that with each total chamber volume of 0.0055 $m^3$ for each rear chamber 76 and 73, and length of 0.17 m, the rear chambers 76 and 78 are tuned at resonant frequencies of approximately 50 Hz. The common chamber 74 has an area of 0.0032 $m^3$ and with a port tube having an area of 0.003 $m^2$ with shaped tuning port 0.05 m by 0.06 m, a port length of 0.05 m will provide a resonant frequency for the chamber and port at about 250 Hz hertz. Each of the membranes has an area of 0.034 square meters and a membrane mass of 0.019 kilograms. The silicone impregnated polyurethane membrane with these dimensions at a compliance of 0.01 meters per Newton has a mechanical resistance of approximately 1 ohm. As configured in this manner, the membrane has a resonant frequency of approximately 220 hertz. Although this resonant frequency may be less than the highest frequency component desired for cancellation of the entire spectrum of the noise signal, the highest frequency components of the noise signal may be attenuated efficiently and economically by passive muffler 56.

Figure 3:
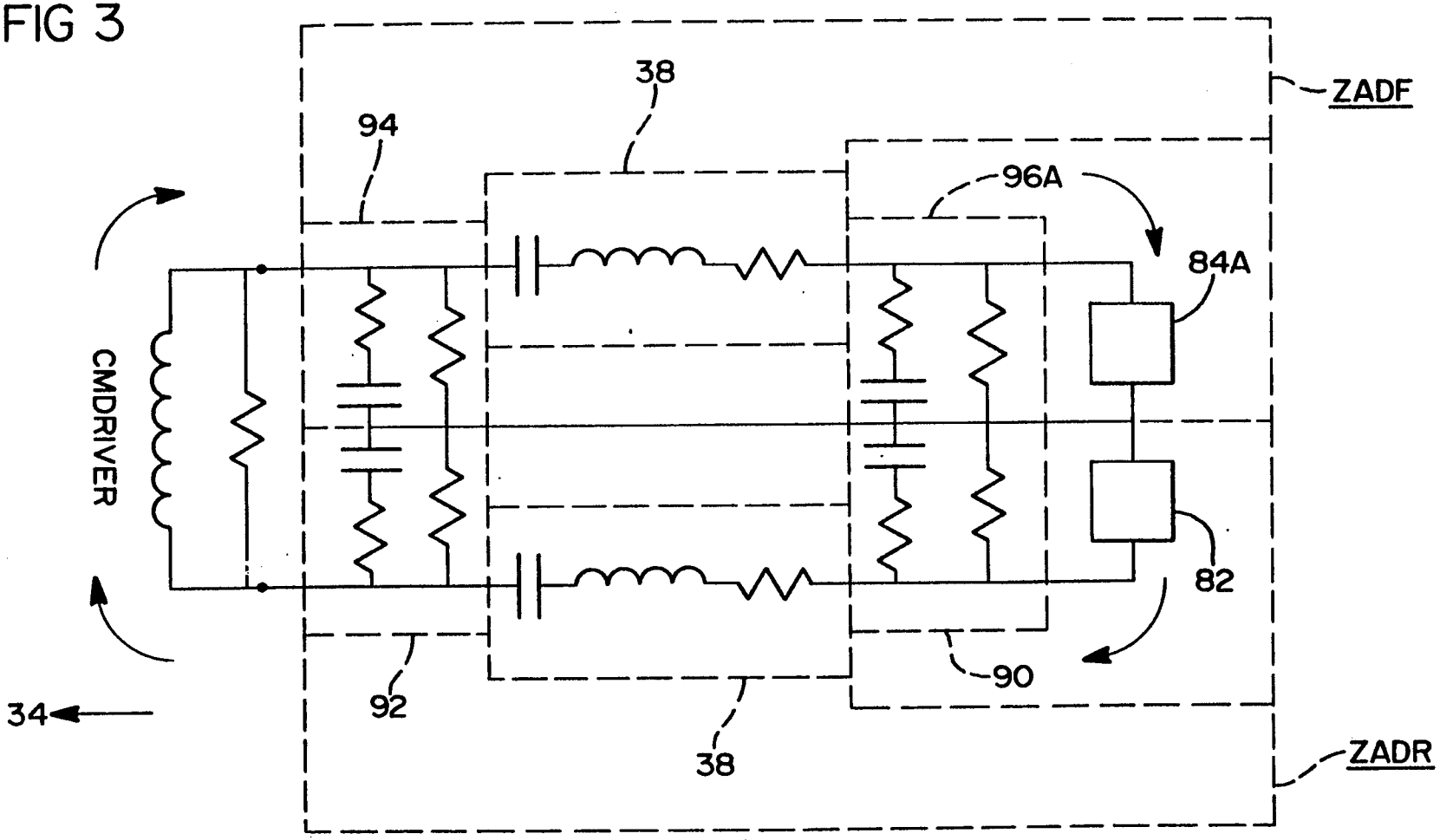
FIG. 3 is a schematic diagram of a design model for the transducer arrangement of the present invention.

A model for determining the appropriate dimensions of the ported transducer housing from the acoustic impedance parameters is shown in FIG. 3, where the acoustic impedance of the left half of the enclosure 58 shown in FIG. 2 is demonstrated. Impedance model boxes 96, 94 and 92 correspond to chamber portions 96, 94 and 92, respectively. Likewise, each of the two membranes 38 are represented by impedance model boxes 38. Duct 82 is represented by the impedance model box 82, whose impedance value is selected to cause resonance at a predetermined frequency.

Thus, for example, where the area of the duct is fixed at a value to provide closed communication with conduit 14, the length of the port 82 can be determined as previously discussed. In addition, the model impedance box 96A represents the impedance of half the chamber 96, as half the area of chamber 96 is used in modeling the right half of the enclosure 58 shown in FIG. 2. It will be understood that the right half model is a mirror image of the left half, but is not shown for the sake of brevity. Similarly, impedance block 84A represents half of the impedance of port 84 connected to common chamber 74.

Having thus described the structural features of the preferred embodiment of the present invention, the transducer arrangement 20 according to the present invention separates hot exhaust gases and moisture from the transducers mounted in the transducer housing an acoustically permeable membranes that passes the sound pressure pulses emanating from each exposed face of the transducer diaphragms. Accordingly, corrosion of the transducer parts is reduced. In addition, the transducer magnet is not subjected to high temperatures which can reduce flux flow or cause demagnetization in conventional loudspeaker constructions. Furthermore, the electrical connections are not subjected to the wide range of expansion and contraction which can normally be expected with exposure to variable temperature environments. Nevertheless, the preferred transducer housing 20 provides improved performance since both sides of the speaker diaphragm may be used to generate cancellation signals, while speaker efficiency is improved by the tuning provided by ported chambers to which they are exposed.

Having thus described the present invention, many modifications thereto will become apparent to those skilled in the art to which it pertains without departing from the scope and spirit of the present invention as defined in the appended claims.

I claim:

1. An active noise cancellation muffler for a motor vehicle exhaust conduit including at least one transducer with a diaphragm, comprising:

a housing including walls defining an enclosed chamber exposed to at least one side of said transducer diaphragm;

a port extending through a housing wall for acoustic communication between said chamber and the exhaust conduit; and an acoustically permeable partition separating said transducer diaphragm from the exhaust conduit.

2. The invention as defined in claim 1 wherein said partition divides said chamber into inner and outer compartments.

3. The invention as defined in claim 1 wherein said housing comprises a tubular peripheral wall and two longitudinally spaced apart end walls.

4. The invention as defined in claim 3 wherein said tubular peripheral wall is cylindrical.

5. The invention as defined in claim 4 wherein said partition is round.

6. The invention as defined in claim 1 wherein said muffler comprises two transducer diaphragms and wherein said housing includes walls defining a first common chamber exposed to one side of each transducer diaphragm, a second chamber exposed to the other side of one said transducer diaphragm and a third chamber exposed to the other side of the other transducer diaphragm.

7. The invention as defined in claim 6 wherein said housing includes a first port acoustically coupling said common chamber with the exhaust conduit, a second port for acoustically coupling said second chamber to the exhaust conduit and a third port for acoustically coupling said third chamber to the exhaust conduit.

8. The invention as defined in claim 7 wherein said common chamber includes a first partition separating said first port from said one transducer diaphragm and a second partition separating said first port from said other transducer diaphragm.

9. The invention as defined in claim 1 wherein said partition comprises a flexible membrane.

10. The invention as defined in claim 9 wherein said flexible member is taut.

11. The invention as defined in claim 9 wherein said membrane comprises a polymer membrane.

12. The invention as defined in claim 9 wherein said membrane includes reinforcing fibers.

13. The invention as defined in claim 12 wherein said reinforcing fibers are made of aromatic polyamide.

14. The invention as defined in claim 13 wherein said membrane is made of Kevlar impregnated silicone.

15. The invention as defined in claim 12 wherein said member includes a polyethylene coating.

16. A transducer housing for active noise cancellation in a conduit comprising:

a peripheral wall defining an enclosed chamber;

a port extending through said peripheral wall in fluid communication with said chamber and the conduit;

a transducer mount for securing a transducer with its diaphragm exposed to said chamber;

an acoustically permeable partition for separating said mount from said port.

17. A method for coupling transducers to a motor vehicle exhaust conduit comprising:

enclosing at least one side of at least one transducer diaphragm in a housing chamber;

porting said chamber in fluid communication with the exhaust conduit;

partitioning said chamber with an acoustically permeable membrane separating said transducer diaphragm from said port.

18. The invention as defined in claim 17 wherein said partitioning step comprises installing a silicone impregnated polyurethane, fiber-reinforced membrane.

19. The invention as defined in claim 18 wherein said fiber is made of aromatic polyamide.

* * * * *

UNITED STATES PATENT AND TRADEMARK OFFICE

CERTIFICATE OF CORRECTION

PATENT NO. : 5,233,137
DATED : August 3, 1993
INVENTOR(S) : Earl R. Geddes

It is certified that error appears in the above-indentified patent and that said Letters Patent is hereby corrected as shown below:

Column 2, line 54, after "noise" delete "propogating" and substitute --propagating--.

Column 6, line 32, after "250 Hz" delete --hertz--.

Column 7, line 6, after "permeable" delete "membranes" and substitute --membrane--.

Column 7, line 5, after "housing" insert --by--.

Signed and Sealed this

Twenty-second Day of March, 1994

Bruce Lehman

*Attest:*

BRUCE LEHMAN

*Attesting Officer*

*Commissioner of Patents and Trademarks*